United States Patent [19]

Sorokes

[11] Patent Number: 4,932,835

[45] Date of Patent: Jun. 12, 1990

[54] VARIABLE VANE HEIGHT DIFFUSER

[75] Inventor: James M. Sorokes, Olean, N.Y.

[73] Assignee: Dresser-Rand Company, Corning, N.Y.

[21] Appl. No.: 333,421

[22] Filed: Apr. 4, 1989

[51] Int. Cl.[5] ..... F04D 17/10

[52] U.S. Cl. ..... 415/150; 415/157; 415/211.2

[58] Field of Search ..... 416/46, 211.2, 208.3, 416/150, 211, 148, 157, 158

[56] References Cited

U.S. PATENT DOCUMENTS

| | | | |
|---|---|---|---|
| 2,739,782 | 10/1952 | White . | |
| 2,846,185 | 7/1955 | Widmer . | |
| 2,996,996 | 8/1961 | Jassniker . | |
| 3,032,259 | 5/1962 | Jassniker . | |
| 3,079,127 | 2/1963 | Rowlett et al. . | |
| 3,228,656 | 1/1966 | Kyogoku | 415/158 X |
| 3,362,624 | 1/1968 | Endress . | |
| 3,365,120 | 1/1968 | Jassniker . | |
| 3,588,270 | 6/1971 | Boelcs . | |
| 3,667,860 | 6/1972 | Endress et al. | 415/1 |
| 3,781,128 | 12/1973 | Bandukwalla | 415/143 X |
| 3,784,318 | 1/1974 | Davis | 415/158 |
| 3,972,642 | 8/1976 | Fricke et al. | 415/145 |
| 4,008,010 | 2/1977 | Fauconnet | 417/405 |
| 4,056,330 | 11/1977 | Lieber | 415/1 |
| 4,070,132 | 1/1978 | Lynch | 415/48 |
| 4,218,182 | 8/1980 | Tsunoda et al. | 415/205 |
| 4,219,305 | 8/1980 | Mount et al. | 415/13 |
| 4,257,733 | 3/1981 | Bandukwalla et al. | 415/13 |
| 4,265,589 | 5/1981 | Watson et al. | 415/47 |
| 4,292,807 | 11/1981 | Rannenberg | 60/601 |
| 4,324,526 | 4/1982 | Berchtold et al. | 415/158 X |
| 4,354,802 | 10/1982 | Nishida et al. | 415/207 |
| 4,378,194 | 3/1983 | Bandukwalla | 415/49 |
| 4,395,197 | 7/1983 | Yoshinaga et al. | 415/211 |
| 4,403,914 | 9/1983 | Rogo et al. | 415/150 X |
| 4,416,583 | 11/1983 | Byrns | 415/148 |
| 4,421,457 | 12/1983 | Yoshinaga et al. | 415/211 |
| 4,460,310 | 7/1984 | Plunkett | 415/26 |
| 4,470,256 | 9/1984 | Palmer | 415/49 X |
| 4,492,520 | 1/1985 | Marchand | 415/150 |
| 4,503,684 | 3/1985 | Mount et al. | 62/115 |
| 4,527,949 | 7/1985 | Kirkland | 415/150 |
| 4,544,325 | 10/1985 | Rogo et al. | 415/150 |
| 4,552,308 | 11/1985 | Rogo et al. | 239/457 |
| 4,579,507 | 4/1986 | Corrigan et al. | 415/150 |
| 4,582,466 | 4/1986 | Szczupak | 415/150 |
| 4,611,969 | 9/1986 | Zinsmeyer | 415/1 |
| 4,626,168 | 12/1986 | Osborne et al. | 415/211 |

FOREIGN PATENT DOCUMENTS

| | | | |
|---|---|---|---|
| 1367967 | 6/1964 | France | 415/158 |
| 696817 | 9/1953 | United Kingdom | 415/158 |

OTHER PUBLICATIONS

CVM Centrifugal Compressors, 1987, Dresser-Rand.

*Primary Examiner*—Everette A. Powell, Jr.

[57] ABSTRACT

A diffuser vane assembly for a centrifugal compressor includes movable vanes which are inserted or retracted from the diffuser passage through slots in one of the diffuser walls. The vane assembly is axially movable by an internally threaded drum and gear arrangement. A hand crank external to the compressor is effective to rotate the drum and thereby axially move the plate and attached vanes within the diffuser passage.

8 Claims, 3 Drawing Sheets

FIG. 4
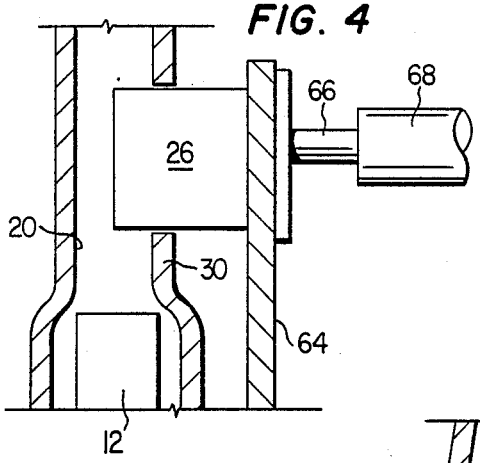
FIG. 5
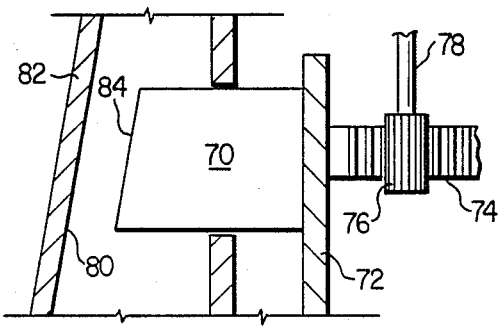
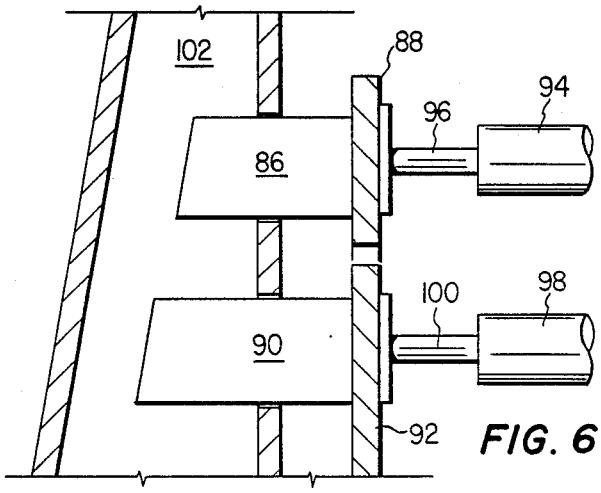
FIG. 6

VARIABLE VANE HEIGHT DIFFUSER

FIELD OF THE INVENTION

This invention pertains generally to methods and apparatus for improving compressor performance, and more particularly to variable height diffuser vanes which are movable into a compressor diffuser section to adjust the performance and provide a wider range of flow rates.

BACKGROUND OF THE INVENTION

Radial, or centrifugal compressors, are constructed in such a manner as to convert a fluid velocity pressure to a static pressure and thereby provide a compression of the fluid. Rotating impellers are effective to impart a velocity pressure to the fluid and deliver the same to a diffuser section where the velocity pressure is converted to a static pressure. The use of fixed vanes in the diffuser section results in improved compressor efficiency, generally at the expense of operating range. Conversely, a vaneless diffuser will yield a wider operating range, but will not achieve a performance level as high as the vaned design. It is well known that the provision of stator vanes in a compressor diffuser section allow velocity pressure recovery of up to three times that of a vaneless diffuser.

Most users require centrifugal compressors which are adapted for operation over a variety of flow conditions and over various ranges. However, there is typically one flow condition at which the compressor most frequent operates. Many users therefore prefer the best possible performance at a "design" condition, but still require some degree of "off-design" performance. Often, this is not possible or practical, as in compressors using vaned diffusers, the performance degrades during "off-design" conditions. This degradation is principally a result of increased losses due to flow incidence of the fluid on the diffuser vanes. Incidence is generally defined as the angle of the vane with respect to the direction of fluid flow around it. If it were possible to partially or totally retract the vanes from a diffuser passage, the losses due to incidence would be relieved, and the flow range would increase.

Prior attempts to address the problem of vane incidence and its resultant effects on flow range fall into two known groups. In the first, alteration of fluid flow angle is accomplished by reducing the diffuser passage width, changing the fluid flow direction accordingly, thus reducing the incidence levels. This approach is shown in U.S. Pat. No. 3,365,120, issued Jan. 23, 1968 to Jassniker. The second approach is to rotate, or otherwise change the orientation of the diffuser vanes to match the fluid flow angle, thus reducing the incidence losses. The second approach suffers certain deficiencies in that it is difficult to accurately pivot all of the vanes to the same angle, primarily due to backlash and mechanical play, thus resulting in flow turbulence. This latter approach is disclosed in a product brochure, "CVM Centrifugal Compressors," 1987, by Dresser-Rand.

SUMMARY OF THE INVENTION

In accordance with the convention, a compressor variable vane arrangement is disclosed which eliminates or substantially reduces the disadvantage or shortcomings of the prior techniques. According to the invention, a compressor diffuser section is disclosed in which the vanes are movable, in unison, into and out of the diffuser passage, whereby the extent of the projection of the vanes into the passage is controlled. The movable vanes are mounted on a ring which encircles the impeller intake flow region. Accordingly, when the vanes are completely retracted from the diffuser passage, the losses due to incidence are relieved and flow range is increased. When the vanes are moved into the diffuser passage, either partially or completely, the pressure recovery is increased proportionately, thus increasing the performance in a desired manner. In the preferred form, the coordinated movement of the vanes into and out of the diffuser passage is accomplished manually by a geared arrangement, in which a toothed drum is employed between an exterior crank and a vane set to allow precise adjustment of the extent to which the vanes extend into the diffuser passage. Other vane adjustment techniques, such as by hydraulics, pneumatics, or mechanics are disclosed.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts or elements throughout the views, and in which:

FIG. 4 shows in cross section a diffuser vane assembly which is axially moved by hydraulic or pneumatic cylinder apparatus;

FIG. 5 shows in cross section an embodiment of the invention wherein a rack and pinion gear is effective to advance and retract vanes within a diffuser passage; and FIG. 6 shows in cross section another embodiment of the present invention wherein a tandem vane array is advanced and retracted with respect to the diffuser passage.

DETAILED DESCRIPTION OF THE INVENTION

Figures 1, 1A:
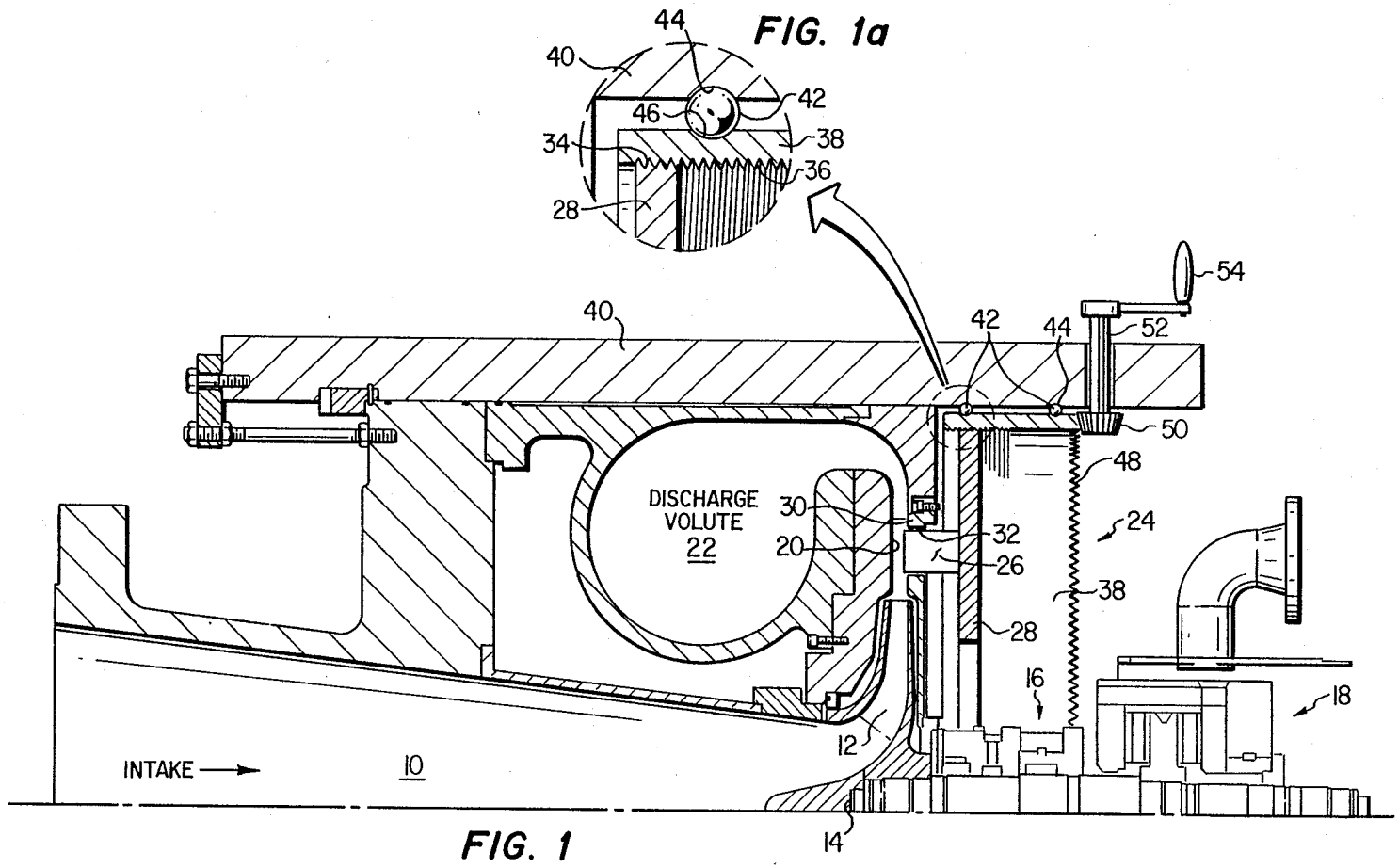
FIG. 1 shows in cross section, a portion of a gas compressor, illustrating the improved variable diffuser of the present invention.

FIG. 1 illustrates a compressor of the type in which the invention may be advantageously practiced. The exemplary compressor has an axial input providing an input gas to a centrifugal compressor section. The illustrated compressor is constructed generally symmetrically, and thus only an upper portion is shown in cross section in FIG. 1. The principles and concepts of the invention can be employed in many other applications in which aerodynamic effects are achieved with movable vanes.

More specifically, the illustrated compressor includes an axial input 10 providing a supply of air or gas to an impeller 12 which is connected to a shaft 14. The axial shaft 14 is supported by an inner bearing 16 and an outer bearing 18 and is driven by an external power source, not shown. The compressor is also provided with conventional labyrinth lubrication seals, thrust bearings, tilt pad bearings and other apparatus conventional to such compressors. The power-driven compressor shaft 14 rotates the impeller 12 at a high speed, sufficient to impart a velocity pressure to the gas drawn into the compressor via intake 10. A number of impellers are arranged symmetrically around the shaft 14 for discharging the gas into a number of diffuser passages, one identified as numeral 20. The diffuser passage 20 functions to convert the velocity pressure of the gas into a static gas pressure which is coupled to a discharge volute 22. While not shown, the discharge volute 22 couples the compressed gas to an output of the compressor. Because of the centrifugal action of the impeller 12, gas can be compressed to a pressure ranging up to about 10,000 psig.

As noted above, it is well known to fix vanes within the diffuser passage 20 to optimize the performance of the compressor around a design point. Also as noted above, the fixed vanes tend to narrow the range of performance before surge and choke conditions become imminent. As is well known, the operation of a compressor at a surge point reverses the flow of gas through the compressor, wherein the compressor becomes unstable and can even enter into a vibration mode. On the other hand, a choke condition of the compressor is imminent when the gas speed approaches Mach 1, wherein the rate of fluid compression is reduced and the performance of the compressor drops sharply. The design point of a compressor defines a flow rate at which the efficiency of the compressor is maximized, as is the flow of gas through the compressor.

Figure 2:
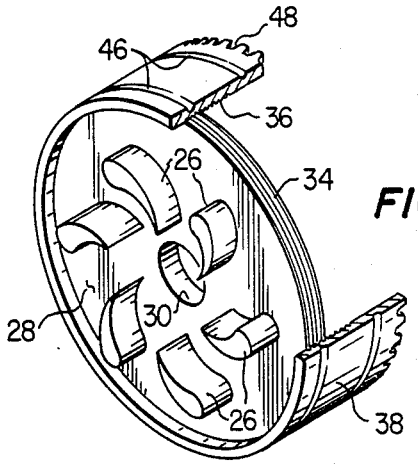
FIG. 2 is an isometric view of a vaned plate and its threaded engagement with a rotatable drum for axially moving the vanes within the diffuser passage.

In accordance with an important feature of the invention, the compressor is provided with diffuser vane apparatus 24 which is adapted for movement of a number of vanes, one shown as reference character 26, into the diffuser passage 20 and thereby alter the performance characteristics of the compressor to the extent desired. According to the preferred form of the invention, and with reference to FIGS. 1 and 2, a number of diffuser vanes 26 are rigidly fixed to an annular plate 28 having a central opening 30 therein to accommodate the compressor shaft 14 which passes therethrough. While the individual vanes 26 are shown as being somewhat circular in shape, other shapes, including straight, wedge, log spiral, etc., can operate with appropriate effectiveness. The diffuser vane plate 28 is located adjacent a diffuser passage wall 30 which has a number of openings 32 which are shaped in a manner similar to a cross-section of the vanes 26. In this manner, the vanes 26 can move in unison, together with the plate 28, in an axial direction such that the vanes 26 are moved in and out of the respective diffuser passages 20. Thus, by axially moving the vanes 26 in and out of the respective diffuser passages 20, a desired compressor performance can be achieved, generally irrespective of the design point around which the compressor was originally constructed.

The vane plate 28 has threads 34 formed annularly around its peripheral edge to effect an axial adjustment thereof. The plate 28 is threadably engaged with internal threads 36 formed on an inner surface of a drum 38. Thus, as the drum 38 is rotated, and because the vaned plate 28 remains stationary due to the vane engagement through the diffuser wall slots 32, the vane plate 28 is caused to be moved axially. A clockwise rotation of the internally threaded drum 38 is effective to move the vaned plate 28 in one axial direction, and a counterclockwise drum rotation is effective to move the vane plate 28 in an opposite direction. Accordingly, by precisely rotating the drum 38 a certain amount, the vanes 26 can be accurately placed within the diffuser passage 20. Importantly, because the number of threads per inch on both the inner surface of the drum 38 and on the peripheral edge of the plate 28 are small, a very fine and accurate axial movement of the vanes 26 can be accomplished. Also, even though a substantial amount of fluid pressure is exerted on the vanes 26 by the centrifugal compressor action of the impellers 12, the vanes 26 remain stationary within the diffuser passage 20, due to the large mechanical leverage of the threads. It is important to understand that by utilizing a drum for achieving axial movement of the vaned plate 28, an efficiency in space can be realized. By this it is meant that the drum generally occupies the space in the compressor near the housing, not otherwise generally utilized by the internal compressor apparatus. Hence, the apparatus for moving the vanes 26 minimally interferes with the location and placement of the other internal compressor apparatus. The drum 38 can be threaded a predefined axial distance so as to provide end points for the travel of the vanes plate 28. In the alternative, tab stops can be welded within the drum 38 against which the vaned plate 28 can abut for limiting the axial movement of the vaned plate 28.

The internally threaded drum 38 is rotatably mounted within a compressor housing 40 by a number of ball bearings 42. The internal surface of the compressor housing 40 includes a pair of annular grooves 44 for providing an opposing race for the ball bearings 42. In like manner, the outer surface of the drum 38 includes a similar pair of annular grooves 46 to provide a race for the ball bearings 42. When the ball bearings 42 are installed between the race grooves 44 and 46, the drum 38 is rotatably mounted within the compressor housing 40. While not shown, the drum 38 has formed on the outer surface thereof axial grooves for initially installing the ball bearings 42 between the respective annular grooves 44 and 46. Such axial grooves can be filled after installation such that the ball bearings 42 remain fixed between the grooves 44 and 46. Those skilled in the art may devise other techniques for rotatably mounting the drum 38 within the housing 40.

Formed around an annular edge of the drum 38 are a number of bevel teeth 48 which are beveled at about 45 degrees, and which are engaged with a corresponding bevel gear 50. The bevel gear 50 is connected to a shaft 52 which is journaled for rotation within the compressor housing 40. The end of the shaft 52 is connected to a hand crank 54 which can be cranked or rotated manually outside of the compressor to achieve a rotation of the drum 38, located within the compressor. A motor or other power driven device can be mounted to the compressor to rotate the shaft 52 in lieu of the hand crank. The diameter of the bevel gear 50 can be selected so as to achieve a desired turns ratio between the crank 54 and the drum 38. Indeed, by proper selection of the gearing between the gear 50 and the drum 38, as well as the thread pitch between the drum 38 and the vane plate 28, a highly precision movement of the vanes 26 within the diffuser passages 20 can be achieved.

Figure 3:
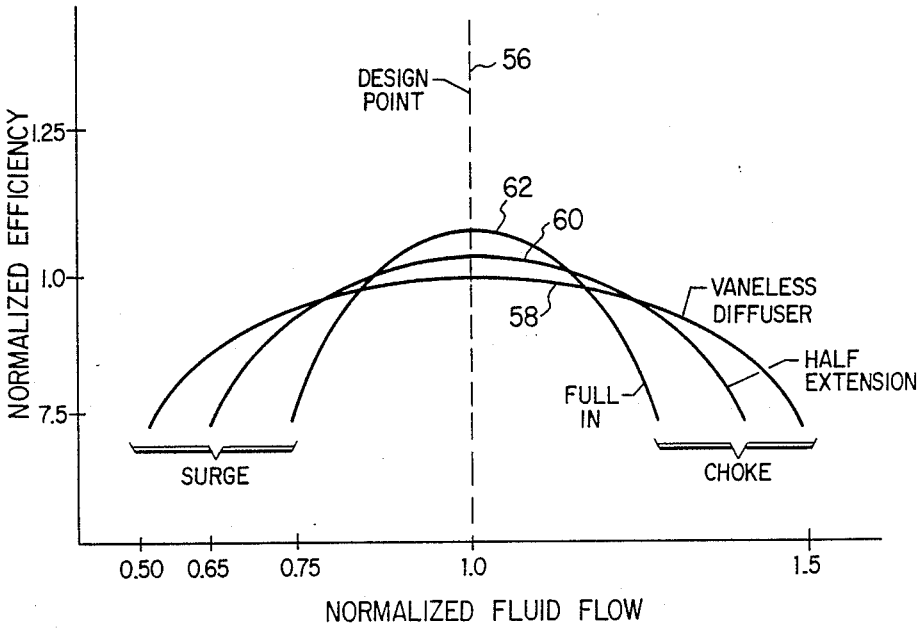
FIG. 3 graphically depicts the effect of movable diffuser vanes on the performance of centrifugal compressors.

FIG. 3 graphically depicts the performance characteristics of a compressor having vanes adjustable within the diffuser passages. The horizontal axis of the graph illustrates normalized fluid flow through a typical centrifugal compressor, while the vertical axis illustrates normalized efficiency. Broken line 56 depicts the design point of a compressor which is typically chosen by a designer so that the compressor exhibits optimized performance in a particular fluid flow range. As can be seen, a compressor not equipped with vanes, or in which the vanes 26 are entirely withdrawn from the diffuser passages 20, exhibits an efficiency which is shown by line 58. As noted, a wider range of fluid flow is accomplished, but at the expense of efficiency. A compressor which is adjusted to provide vanes 26 extending about halfway within the respective diffuser passages 20, has a higher efficiency as shown by line 60, but with a narrowed range of fluid flow between surge and choke conditions. Still further increases in efficiency can be achieved by fully inserting the vanes within the respective diffuser passages 20, as illustrated by line 62. Again, the performance range is narrowed between surge and choke conditions, but a high efficiency can be achieved. It can thus be appreciated that by providing a centrifugal compressor with axially adjustable vanes, desired performance characteristics can be achieved between surge and choke conditions. Importantly, the vane arrangement of the invention can be precisely adjusted axially and maintained at a predetermined position so as to achieve any of the possible performance conditions of the compressor.

While the preferred embodiment of the invention is illustrated in FIG. 1, other variations may be employed by those skilled in the art to adjust the vanes within the diffuser passages. For example, FIG. 4 illustrates a rigid annular plate 64 having a number of vanes 26 fastened thereto. The plate 64 is attached to a shaft 66 of a hydraulic cylinder 68. While not shown, the hydraulic cylinder 68 is fixed with respect to the compressor, and thus when activated by a pressurized hydraulic fluid, the piston 66 can be extended or retracted. As a result, the plate 64, and also the vanes 26 attached thereto, can be extended or retracted with in the diffuser passages 20.

FIG. 5 illustrates yet another embodiment of the invention including a number of vanes 70 which are fixed to a rigid annular plate 72. The plate 72 is, in turn, fixed to a toothed shaft 74. The teeth of shaft 74 mate with the teeth of a gear 76 which is connected to a shaft 78 and driven by a rotary power source, not shown. A rack and pinion arrangement is thus provided. By rotating the shaft 78, the toothed bar 74, which is engaged therewith, moves laterally, thereby moving the vanes 70 into or out of the diffuser passages 80. As noted, a diffuser side wall 82 is slanted, as is an edge 84 of the vanes 70 With this arrangement, the vanes 70 can be completely extended into the diffuser passage 80, flush with the diffuser wall.

A twin vane assembly with dual adjustments is shown in FIG. 6. A first set of vanes 86 is fixed to a first annular ring 88, while a second set of vanes 90 is fixed to a second plate 92. The annular ring 88 is laterally adjustable by a hydraulic cylinder 94 and associated movable piston 96. In like manner, the plate 92 is laterally moved by a second hydraulic piston 98 and associated movable piston 100. Hydraulic cylinders 94 and 98 are each fixed with respect to the compressor so that when individually activated, the corresponding sets of vanes 86 and 90 can be individually and independently moved into or out of the diffuser passage 102. By providing a twin set of independent and concentrically arranged vanes 86 and 90, a high degree of control can be realized over the fluid flow through the diffuser passages 102.

From the foregoing, disclosed is a compressor having a movable vane assembly which is axially movable so that the set of vanes attached thereto can be adjusted within the diffuser passage to achieve a desired performance characteristic of the compressor. In the preferred form of the invention, the diffuser vanes are attached to a plate which is threadably engaged to a drum. The drum is, in turn, rotatable by manual means external to the compressor so that a desired diffuser vane setting can be accomplished. Minute lateral adjustments of the diffuser vanes can be achieved so that the static pressure level in the diffuser passage can be regulated, as desired, to achieve a specific performance characteristic.

While the preferred and other embodiments of the invention have been disclosed with reference to specific diffuser vane adjustment mechanisms, it is to be understood that many changes in detail may be made as a matter of engineering choices without departing from the spirit and scope of the invention, as defined by the appended claims.

What is claimed is:

1. A centrifugal compressor equipped with diffuser vanes, comprising:

an impeller for compressing a fluid;

a diffuser passage defined by opposing sidewalls, one said sidewall having a plurality of slots therein;

a circular plate having a plurality of diffuser vanes attached thereto, said diffuser vanes extending through respective slots of said diffuser sidewall, said plate having threads on an annular edge thereof;

a drum having annular threads engagable with the threads of said plate, said drum having gear teeth, and being rotatable within a housing of said compressor;

a gear mateable with the teeth of said drum; and means for driving said gear so that rotation thereof is effective to rotate said drum and laterally move said plate, whereby said vanes are laterally moved in said diffuser passage.

2. The centrifugal compressor of claim 1, wherein said drum includes internal threads engagable with threads on a peripheral edge of said plate.

3. The centrifugal compressor of claim 1, wherein said drum includes gear teeth on an annular end edge thereof, mateable with said gear.

4. The centrifugal compressor of claim 1, wherein said driving means comprises a hand crank.

5. The centrifugal compressor claim 1, wherein said drum is bearinged to said housing for rotation therein.

6. The centrifugal compressor of claim 5, wherein said housing is cylindrically shaped having plural inner annular grooves, and said drum has plural outer annular grooves, and including plural ball bearings between said inner and outer grooves.

7. The centrifugal compressor of claim 1, wherein said vanes each have an angled edge corresponding to an angled said diffuser wall.

8. The centrifugal compressor of claim 1, wherein said plate is ring-shaped so that an impeller shaft can extend centrally therethrough.

* * * * *